United States Patent [19]

Mitsuhashi

[11] Patent Number: 4,499,168

[45] Date of Patent: Feb. 12, 1985

[54] FIXING METHOD

[75] Inventor: Yasuo Mitsuhashi, Yokohama, Japan

[73] Assignee: Canon Kabushiki Kaisha, Tokyo, Japan

[21] Appl. No.: 605,973

[22] Filed: Apr. 27, 1984

Related U.S. Application Data

[63] Continuation-in-part of Ser. No. 348,171, Feb. 12, 1982, abandoned, which is a continuation of Ser. No. 166,918, Jul. 9, 1980, abandoned.

[30] Foreign Application Priority Data

Jul. 17, 1979 [JP] Japan ..... 54-90745
Aug. 10, 1979 [JP] Japan ..... 54-102489

[51] Int. Cl.[3] ..... G03G 13/20

[52] U.S. Cl. ..... 430/99; 430/109; 430/122; 430/126

[58] Field of Search ..... 430/99, 109, 122, 126

[56] References Cited

U.S. PATENT DOCUMENTS

| | | | |
|---|---|---|---|
| 2,221,776 | 11/1940 | Carlson | 430/48 |
| 2,297,691 | 10/1942 | Carlson | 430/55 |
| 2,618,552 | 11/1952 | Wise | 430/121 |
| 2,874,063 | 2/1954 | Greig | 430/108 |
| 3,901,695 | 8/1975 | Shelffo | 430/107 |
| 3,909,258 | 9/1975 | Kotz | 430/122 |
| 3,938,992 | 2/1976 | Jadwin et al. | 430/107 |
| 3,941,898 | 3/1976 | Sadamatsu et al. | 430/121 |
| 3,965,021 | 6/1976 | Clemens et al. | 430/122 |
| 4,246,332 | 1/1981 | Tanaka et al. | 430/110 |

FOREIGN PATENT DOCUMENTS

| | | | |
|---|---|---|---|
| 2352604 | 5/1974 | Fed. Rep. of Germany | 430/122 |
| 53-96839 | 8/1978 | Japan . | |
| 1165406 | 8/1966 | United Kingdom | 430/122 |
| 1435850 | 5/1974 | United Kingdom | 430/110 |
| 1165405 | 7/1977 | United Kingdom | 430/122 |

*Primary Examiner*—John E. Kittle
*Assistant Examiner*—John L. Goodrow
*Attorney, Agent, or Firm*—Fitzpatrick, Cella, Harper & Scinto

[57] ABSTRACT

Fixing method, in which developing powder containing therein vinyl type polymers having at least one molecular peak thereof in the molecular weight regions of $10^3$ to $8\times10^4$ and $10^5$ to $2\times10^6$, respectively, in a chromatogram measured by the gel permeation chromatography (G.P.C.) is fixed by a fuser roller.

23 Claims, 2 Drawing Figures

FIXING METHOD

This application is a continuation-in-part of application Ser. No. 348,171, filed Feb. 12, 1982, now abandoned, which in turn is a continuation of application Ser. No. 166,918, filed July 9, 1980, now abandoned.

BACKGROUND OF THE INVENTION

1. Field of the Invention

This invention relates to a fixing method of developing powder to be used for the electrophotographic method, electrostatic recording method, magnetic recording method, and so forth.

2. Description of the Prior Art

For the electrophotographic method, there have so far been known various types such as those in U.S. Pat. No. 2,297,691, British Pat. No. 1,165,406, British Pat. No. 1,165,405, and so forth. These methods are to obtain, by various means, reproduced images through the process steps of forming an electrical latent image on a photosensitive member constructed with a photoconductive material, developing the latent image using a developing toner, then transferring the toner image onto an image transfer material such as paper, depending on necessity, and finally fixing the thus transferred image by heat, pressure, or solvent vapor. When the step of transferring the toner image onto the image transfer material is include in the whole process steps, there is further added a step of removing residual toner.

The method of visualizing the electrical latent image with use of a toner has been known, for example, from U.S. Pat. No. 2,874,063 disclosing the magnetic brush method, U.S. Pat. No. 2,618,552 disclosing the cascade developing method, U.S. Pat. No. 2,221,776 disclosing the powder clouding method, and U.S. Pat. No. 3,909,258 disclosing a method of using an electrically conductive magnetic toner, and others.

For the toner suitable for these developing methods, there has so far been used fine powder of natural or synthetic resin material, in which dyestuff and pigment are dispersed. For example, pulverized powder particles of 1 to 30 microns or so in diameter prepared by dispersing a coloring matter in a binder resin such as polystyrene are used as the toner. For the magnetic toner, there has been used magnetite, and the like containing therein magnetic particles. In the case of the system which utilizes the so-called two-component developer, the toner is used in mixture with carrier particles such as glass beads, iron powder, etc.

These toners are required to have various physical and chemical properties, but most of the known toners have some defects to be mentioned as follows. That is, most of the toners which readily melt by heating tend to be caked or coagulated during storage or within the reproduction apparatus. Most of the other toners deteriorate their triboelectric property and fluidity due to temperature changes in the surroundings. Most of still other toners cause change in the image density or increase in the background density due to mutual deterioration among the toner, the carrier particles and the photosensitive member occurring from collision among the toner particles and the carrier particles as well as contact between these particles and the surface of the photosensitive plate member as the result of repetitive development owing to continuous use of the reproduction apparatus. Further, most of yet other toners causes increase in the background density when the density of the reproduced image is to be augmented by increasing the adhering quantity of the toner to the surface of photosensitive plate member, thereby causing the so-called fogging phenomenon.

Of these various undesirable phenomena as mentioned above, there is such one that occurs due to brittleness of the toner particles. Being brittle, the toner particles are readily pulverized by mechanical fore, which appears preferable from the standpoint of productivity of the toner. On the other hand, however, such toner particles are liable to be readily crushed even by a load applied to them within the developing device and become pulverized to bring about undesirable phenomena such as contamination of the carrier particles and the developing sleeve, or fogging phenomenon to the reproduced image due to the toner particles per se becoming unable to be perfectly controlled in their charge. Such brittleness in the toner particles greatly affects the life of the developing agent.

With a view to avoiding such deteriorating phenomena, there has been contemplated use of various polymerized substances having high molecular weights. In consideration, however, of the image fixing under heat which is usually done at the ultimate step of the reproduction, since the fixing temperature should be elevated at the time of the image, fixing with such polymer substance, necessitating much more heat quantity, it is not so preferable from the standpoint of the energy saving. It has also been proposed to add a small amount of a plasticizer in the toner to eliminate such deteriorating phenomenon. This proposal is again problematical in that it impairs fluidity of the toner and also contaminates the carrier particles, etc., hence it is not always successful.

Conversely, when the toner is too hard, mechanical crushing is not feasible to make it difficult to practically manufacture the toner.

For various reasons as mentioned in the foregoing, there has so far been used, as the binder resin for the toner, polystyrene or copolymers of styrene and butyl methacrylate having a relatively low molecular weight of a few to several thousands and having an appropriate hardness.

Of recent, however, strong demands have been clamoured from among various circles of users as to improvement in operational reliability of the reproduction apparatus. On the part of the manufacturers of the reproduction apparatus, they are now endeavoring in development and manufacture of such reproduction apparatus having a longer service life from the standpoint of maintenance. Under such situations, when the various characteristics of the toner are reviewed, it has been discovered that polystyrene or copolymers of styrene and butyl methacrylate of relatively low molecular weights as mentioned above are not satisfactory in their hardness as the binder resin for the toner, and that materials having higher hardness are required.

The image fixing method which has been most generally diffused in the reproduction apparatus in recent years is the fuser roller fixing method. In most of the fuser roller image fixing device incorporated in the reproduction apparatus which is now commercialized, it is the usual practice to apply oil on the surface of the roller. However, this oil application causes disagreeable feeling to an operator due to vaporization of the oil, stain of the sheet due to the oil, complexity in the construction of the fixing device which is liable to mechanical trouble not infrequently, and increase in the manufacturing cost, and various other undesirable problems. Accordingly, it has been expected that the fuser roller image fixer with no oil applied on the roller or, if applied, with very small quantity of application would emerge. Such improvement cannot be realized without improvement in the toner itself. The very point of difficulty in adopting the fuser roller image fixing device without oil being applied on the roller is that the toner should have sufficient separability from the image fixing roller to compensate the non-oil-application. Therefore, it is difficult to obtain the toner having anti-offset property and anti-twining property, while maintaining as low a fixing point as possible, and it is more difficult to obtain the toner which is excellent in both image fixing and developing characteristics.

In the conventional toner, the binder resin is such one that it has a molecular weight distribution curve with one molecular peak value, or it has a plurality of peak values in the low molecular weight region, or it is a mixture of entirely different compounds, each having different molecular weight distribution.

Such toner as mentioned above cannot be said to be excellent toners in both image fixing and developing characteristics.

There have so far been proposed various methods for improving the image fixing property of the toner with respect to the fuser roller fixing. For example, U.S. Pat. No. 3,941,898 teaches the toner, in which a cross-linked polymer is used as the binder resin. According to this patented method, remarkable improvement can be seen in respect of the anti-offset property and the anti-twining property, but there still remain various disadvantages such that no satisfactory image fixing property can be obtained by mere cross-linking since the fixing temperature is still low, and that, as the cross-linked polymer is difficult to disperse pigment and is incompatible with other polymers, the toner using such cross-linked polymer as the binder resin is difficult to have satisfactory developing characteristics. Also, German laid-open patent application DOLS 2352604 proposes a toner, in which a low molecular weight polypropylene is blended with a styrene type resin. According to the invention as laid open, it is necessary to include a large amount of low molecular weight polypropylene so as to obtain a satisfactory effect with respect to the anti-offset property. On the other hand, however, coagulating property of the toner increases to disadvantageously deteriorate its developing characteristics.

SUMMARY OF THE INVENTION

It is therefore an object of the present invention to provide a fixing method which does not cause offsetting of the toner image onto the fuser roller.

It is another object of the present invention to provide a fixing method which is able to adopt a fuser roller fixing device, in which no oil is applied onto the roller.

It is still another object of the present invention to provide a fixing method using developing powder which is less liable to adhere to the carrier particles, the toner holding member, the surface of the photosensitive member, the cleaning blade, and so forth, is less liable to impair these members, is excellent in its shock-resisting property, does not cause coagulation, is excellent in its fluidity and durability, and has a low fixing temperature.

According to the present invention, generally speaking, there is provided a fixing method, in which developing powder containing therein vinyl type polymer material having at least one molecular peak value thereof, respectively, in the molecular weight regions of $10^3$ to $8\times10^4$ (more preferably $5\times10^3-8\times10^4$) and $10^5$ to $2\times10^6$ (more preferably $10^5-1.5\times10^6$) in a chromatogram measured by the gel permeation chromatography (G.P.C) is fixed by a fuser roller.

DESCRIPTION OF THE PREFERRED EMBODIMENT

Figure 1:
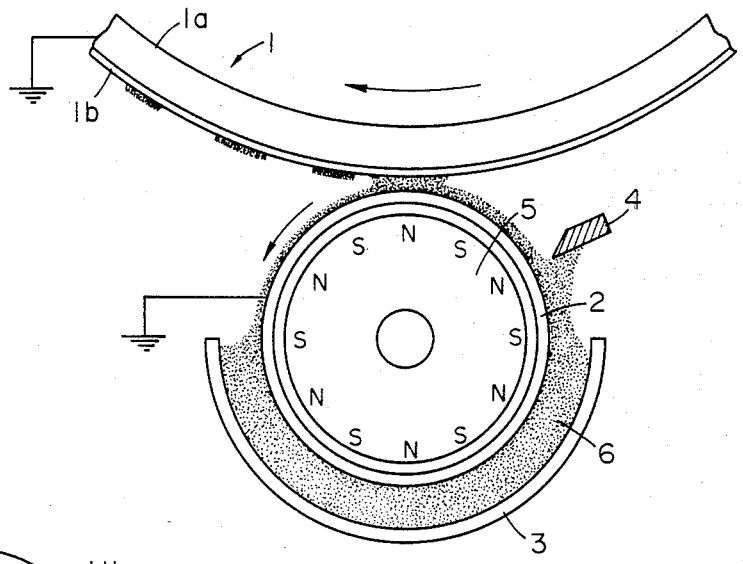
FIG. 1 is a schematic cross-sectional view of a developing device which utilizes magnetic developer.

An effective contribution to attain the abovementioned object is rendered by a vinyl type polymer having a molecular peak value in a molecular weight region of $10^5$ to $2\times10^6$ in a chromatogram measured by the gel permeation chromatography (G.P.C.). It should, however, be noted that, when the polymer having the molecular weight in this region increases, the image fixing temperature for the heat fixing is accordingly elevated. Such phenomenon is not preferable from the standpoint of the energy saving, as already mentioned in the foregoing. It is therefore become necessary that another polymer having its peak value in the molecular weight region of $10^3$ to $8\times10^4$ in the GPC chromatogram be mixed in an appropriate quantity. Such polymer may either be adjusted in its synthesizing stage so that its molecular weight has at least one peak value in the respective regions of $10^3$ to $8\times10^4$ and $10^5$ to $2\times10^6$, or be prepared by blending a polymer (P) having its peak value in the molecular weight region of $10^3$ to $8\times10^4$ and polymer (Q) having its peak value in the molecular weight region of $10^5$ to $2\times10^6$. In the latter case, the blending ratio (by weight) of the polymers (P) and (Q) should preferably be Q/P=2/1 to 1/50. In the ratio where Q/P is greater than 2/1, if and when the heat fixing method in general use at present is adopted, an enormous amount of heat energy is required, which is not preferable. On the other hand, in the ratio where Q/P is less than 1/50, no blending effect of the polymers P and Q can be recognized. While it is not always necessary that the composition of the polymers P and Q be identical, the principal component of their monomers should preferably be indentical.

In order to measure the molecular weight of the vinyl type polymer at its peak value position in the molecular weight distribution curve for the purpose of the present invention, there may usually be used an appropriate method in accordance with the gel permeation chromatography to be mentioned as follows.

1. Conditions for Measurement:

| | | |
|---|---|---|
| (a) | Temperature | 25° C. |
| (b) | Solvent | tetrahydrofuran solution |
| (c) | Flow rate | 1 ml/min. |
| (d) | Concentration of sample | 8 mg/ml of tetrahydrofuran solution |
| (e) | Pouring quantity of sample | 0.5 ml |

2. Column:

In order to secure adequate measurement of the molecular weight region of $10^3$ to $2\times10^6$, a plurality of numbers of polystyrene gel columns available in general market are used in combination.

Followings are the examples of preferred combination:

(1) Combination of "μ-STYRAGEL" (product of Waters Inc.) 500, $10^3$, $10^4$ and $10^5$.

(2) Combination of "SHODEX" (product of Showa Denko K.K.) A-802, A-803, A-804 and A-805.

3. Calibration Curve:

The calibration curve is drawn by using a standard polystyrene. For the standard polystyrene to be used, those of Pressure Chemical Co. or Toyo Soda Kogyo K.K. having the molecular weights of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$, and $4.48\times10^6$ are preferable. It is proper to use at least ten kinds of such standard polystyrene.

4. Detection Device:

An RI (refractive index) detector is used.

The vinyl type polymer suitable for the present invention is one that contains therein a vinyl type monomer. Examples of the vinyl type monomer are: styrene and its substitution products; monocarboxylic acid and its substitution products having a double bond such as acrylic acid, methyl acrylate, ethyl acrylate, butyl acrylate, dodecyl acrylate, octyl acrylate, phenyl acrylate, methacrylic acid, methyl methacrylate, ethyl methacrylate, butyl methacrylate, octyl methacrylate, acrylonitrile, methacrylonitrile, acryl amide, and so on; dicarboxylic acid and its substitution products having a double bond such as maleic acid, butyl malenate, methyl malenate, dimethyl malenate, and so on; vinyl esters such as vinyl chloride, vinyl acetate, vinyl benzoate, and so on; vinyl ketones such as vinyl methyl ketone, vinyl ethyl ketone, and so on; vinyl ethers such as vinyl methyl ether, vinyl ethyl ether, vinyl isobutyl ether, and so on. These vinyl monomers may be used singly or in combination. Of these vinyl type polymers, the styrene type copolymers are found to be preferable.

These vinyl type polymers having the abovementioned G.P.C chromatogram are contained as the binder resin at a rate or 30 to 90% by weight (more preferably 50 to 85% by weight) with respect to the total weight of the developing powder.

The styrene type copolymers are the copolymers of styrene and its substitution products such as α-methyl styrene, p-chlorostyrene, etc. and other monomers. The copolymerization ratio of this styrene type monomer in the styrene type copolymers should preferably be 30 to 95% by weight (or more preferably 50 to 90% by weight, or most preferably 60 to 85% by weight). For the preferable copolymerization counterparts to the styrene type monomers in the styrene type copolymers, there are: alkyl ester of acrylic acid (the alkyl group therein having the carbon content of from 1 to 15), alkyl ester of methacrylic acid (the alkyl group therein having the carbon content of from 2 to 15), and so forth.

It is also possible to blend the styrene type copolymers with other vinyl type polymers. In this case, blending ratio of the styrene type copolymers should preferably be 50 to 100% by weight (more preferably 70 to 100% by weight, or most preferably 90 to 100% by weight) with respect to the total quantity of the vinyl type polymer blend.

The styrene type copolymers used for the present invention can be synthesized by the well known polymerization methods such as the suspension polymerization, emulsion polymerization, solution polymerization, bulk polymerization, and so on. For adjustment of the molecular weight, it is possible to use the well known molecular weight adjusters such as, for example, lauryl mercaptan, phenyl mercaptan, butyl mercaptan, dodecyl mercaptan, and other mercaptans; and carbon tetrachloride, carbon tetrabromide, and other halogenated carbons.

In other to obtain the developing powder more suitable for the fuser roller fixing by blending different kinds to styrene type copolymers, it may be satisfactory to prepare a polymer blend containing therein a styrene type copolymer A and another styrene type copolymer B, in which a relationship between the styrene type copolymer A (having a mean molecular weight of $M_A$ and a copolymerization ratio of the styrene type monomers of $W_A$% by weight) and the styrene type copolymer B (having a mean molecular weight of $M_B$ and a copolymerization ratio of the styrene type monomers of $W_B$% by weight) is such that $M_A<M_B$, and $W_A>W_B$.

In this instance, the copolymerization ratio of the styrene type monomer in the resulting copolymer is 50 to 98% by weight in the case of the copolymer A, and 35 to 90% by weight in the case of the copolymer B.

The important points to be borne in mind in this case are that (1) the binder resin is a mixture of the styrene type copolymers having different mean molecular weight, (2) the copolymerization ratio of the styrene type monomer in the copolymer having the higher mean molecular weight is smaller than that in the copolymer having the lower mean molecular weight, and (3) the copolymer should preferably be a styreneacryl type copolymer. From these points, the following characteristics would result.

The first characteristic is that the copolymer having larger mean molecular weight gives satisfactory anti-offset and anti-twining properties, while the copolymer having low mean molecular weight gives the low fixing temperature characteristic. Such favorable characteristics cannot be obtained from the toner containing therein a polymer, as the binder resin, having only one peak value in its molecular weight distribution curve.

The second characteristic makes the abovementioned tendency more preferable. That is to say, while the polymer having a low mean molecular weight becomes excellent in its developing characteristic and anti-blocking characteristic by increasing the content of the styrene type monomer therein and its transition temperature Tg becomes high, its fixing temperature is scarcely elevated due to its low molecular weight. On the other hand, the polymer having a high mean molecular weight lowers its fixing temperature by reducing the content of the styrene type monomer.

The third characteristic is that, by appropriate combination of the monomers, excellent characteristics can be obtained in both development and image fixing. These excellent characteristics appear to be ascribable to the styrene type monomer which contributes much more to the development, and the acryl type monomer which contributes much more to the image fixing.

The developing powder according to the present invention may contain, besides the abovementioned vinyl type polymers, the following compounds at a ratio less than the content of the vinyl type polymers. Such compounds are: silicone resin, polyester, polyurethane, polyamide, epoxy resin, polyvinyl butyral, rosin, modified rosin, terpene resin, phenol resin, aliphatic or alicyclic hydrocarbon resin, aromatic petroleum resin, chlorinated paraffin, paraffin wax, and so forth.

For the fine particles of magnetic material to be included in the developing powder to obtain the magnetic toner, there are, for example: iron, manganese, nickel, cobalt, chromium, and other metals; magnetite, hematite, various kinds of ferrites, manganese alloys, and other ferromagnetic alloys. Any material that exhibits the magnetic property or that is magnetizable may be used for the purpose. These materials are pulverized to an average particle diameter of from 0.05 to 5 microns (more preferably from 0.1 to 2 microns) for use. Content of the magnetic fine particles to be included in the magnetic powder should preferably be 15 to 70% by weight (more preferably from 25 to 45% by weight) with respect to the total weight of the developing powder.

Further, the toner to be used in the present invention can be added with various kinds of additive materials for the purpose of coloring, charge control, etc. Such additives are, for example: carbon black, iron black, graphite, nigrosine, metal complex of mono-azo dye, prussian blue, phthalocyanine blue, hansa yellow, benzidine yellow, quinacridone, and various kinds of lake pigment. Also, polytetrafluoroethylene, compounds having lubricating property such as fatty acids and their metal salts and bis-amide, plasticizers such as dicyclohexyl phthalate, etc. may be added. As a fluidity improving agent, hydrophobic colloidal silica, etc. may also be contained in the developing powder at a rate of 10 to 40% by weight. This fluidity improving agent may, of course, be separately added outside the developing powder for use. The adding quantity at that time is from 0.05 to 5% by weight with respect to the total weight of the developing powder.

The above-described developing powder prepared from the binder resin, magnetic powder, coloring matter, charge control agent, and so forth has been found to have high durability against loads which it undergoes within the developing device, and also has not been found in its durability test to deteriorate due to pulverization. On the contrary, it has been discovered that, since the toner particle has high hardness, the other materials used in the reproduction apparatus such as, for example, the photosensitive member surface, the cleaning member, the developing sleeve surface, the carrier particles, etc. are prone to be subjected to friction or impairment. In order therefore to remove such disadvantage, there is further added a very small amount of ethylene type olefin homopolymers or copolymers having a melt viscosity of 10 to $10^6$ cps at 140° C. At the time of addition, if the polymer is added to the developing powder from outside for use, there inevitably takes place variations in the weight ratio between the polymer and the developing powder during the repetitive use to thereby cause variations in the developing characteristic, etc., hence the additive should be contained in the developing powder itself ab initio.

When the olefin polymer of the abovementioned viscosity range is contained in the developing powder at a rate of 0.1 to 5% by weight (preferably from 0.2 to 3% by weight), dispersibility and compatibility of the pigment and magnetic fine powder with respect to the developing powder are improved, whereby mal-effects to the photosensitive member surface, the cleaning member, etc. become reduced.

Here, suitable as the ethylene type olefine homopolymers and the ethylene type olefin copolymers are: polyethylene, polypropylene, ethylene-propylene copolymer, ethylene-vinyl acetate copolymer, ethylene-ethyl acrylate copolymer, ionomer having therein the polyethylene skeleton, and so forth. The abovementioned copolymers should contain therein an olefin monomer at a ratio of 50 to 100 mol% (more preferably 60 to 100 mol%). For measurement of the melt viscosity, the Brookfield Method is used. In this case, use is made of a B-type viscometer, to which a small quantity sample adaptor is attached.

The developing powder according to the present invention is used as the developer for an electric latent image with iron powder, glass beads, nickel powder, ferrite powder, and other carrier particles being mixed depending on necessity. Also, this developing powder may be mixed with hydrophobic colloidal silica to improve its fluidity, or with abrasive powder such as cerium oxide to prevent toner from its sticking.

In the following, explanations will be given as to the electrophotographic method, in which the developing powder according to the present invention is used.

For the latent image developing process using the toner, there are the magnetic brush method, the cascade developing method, the powder clouding method, the method of using an electrically conductive magnetic toner (as disclosed in U.S. Pat. No. 3,909,258), the method of using high resistance magnetic toner, and others, as already mentioned in the foregoing. The developing powder according to the present invention is most suited for the developing method which utilizes the so-called single component developer containing therein the magnetic fine particles.

For the image transfer process to be adopted in the present invention, in which a developed image is transferred onto an image transfer member, there may be used the corona transfer system, the bias transfer system, the electrically conductive roller system, and other electrostatic transfer systems, and the magnetic field transfer system.

Further, the toner removing process in the present invention, in which residual toner on the photosensitive layer or the insulating layer is removed, may be selected from the blade cleaning system, the fur brush cleaning system, and so on.

The image fixing is done by the fuser roller. In more detail, the developing powder image on the image bearing member is caused to pass through a pair of rollers, at least one of which is maintained in its heated condition to fuse the developing powder on the image bearing member. The developing powder used in the image fixing according to the present invention does not bring about offsetting of the image onto the roller or twining of paper therearound. The surface of this roller should preferably be coated with a fluorine resin or silicone rubber. Coating with the latter is more preferable. Furthermore, separation liquid such as silicone oil, etc. may be applied onto the fuser roller.

EXAMPLE 1

The following component materials are pulverized and well mixed in a ball mill and then melted and kneaded in a roll mill.

Polymer blend consisting of 80 parts by weight of styrene-butyl acrylate copolymer having a mean molecular weight of 9000 (monomer weight ratio of 65:35) and 20 parts by weight of styrene-butyl acrylate copolymer having a mean molecular weight of 205,000 (monomer weight ratio of 65:35), and having peak values of 10,500 and 200,000 in the molecular weight distribution curve by GPC . . . 100 parts by weight Magnetic powder (consisting of $Fe_3O_4$ having an average particle diameter of 0.3 microns) . . . 60 parts by weight Metal containing dye ("Zapon Fast Black B", product of BASF) . . . 2 parts by weight Polyethylene having a melt viscosity of 4300 cps at 140° C. . . . 2 parts by weight After cooling the kneaded mixture, it is roughly crushed by a hammer mill, and then pulverized by a supersonic jet crusher. The thus obtained powder material is classified by an air classifier, out of which particles having particle size of from 5 to 35 microns are collected and made the developing powder. To 100 parts by weight of this developing powder, there is added and mixed 0.3 part by weight of hydrophobic colloidal silica powder, thereby obtaining the developing agent for use in the present invention. The image developing is carried out in the following manner using this developer.

Onto the surface of an insulating layer of the photosensitive drum in a three-layered structure consisting of the insulating layer made of a polyester resin, a photosensitive layer made of CdS and acrylic resin, and an electrically conductive substrate, there is applied a uniform charging by corona discharge of +6 KV at a linear surface speed of the drum of 168 mm/sec. Subsequently, an a.c. corona discharge of 7 KV is applied simultaneously with the original image irradiation, after which the overall drum surface is uniformly exposed, thereby forming an electrical latent image on the surface of the photosensitive member.

The thus obtained latent image is developed with a developing device shown in FIG. 1. In the drawing, the photosensitive drum 1 rotates at a constant speed in an arrow direction. The electrically conductive substrate 1*a* is electrically grounded. The photosensitive layer 1*b* is covered with the insulative layer. A cylindrical sleeve 2 is for bearing thereon the developer and conveying the same. It has a diameter of 50 mm, has a magnet roll 5 fixed unrotatably inside the cylinder to maintain the surface magnetic flux density of 700 gausses, and has the same peripheral speed as that of the photosensitive drum 1 (the rotational direction being opposite to that of the photosensitive drum). A distance between the photosensitive drum surface and the sleeve surface is set at 0.15 mm, and an a.c. bias of 200 Hz and 600 V is applied to the sleeve surface. A container 3 for accommodating therein the insulative magnetic developer 6 is disposed at such a position that the developer as placed therein may contact the surface of the cylindrical sleeve 2. An iron blade 4 is disposed at a distance of 0.1 mm off the cylindrical sleeve surface 2. The blade 4 functions to regulate the quantity of the developer moving on the cylindrical sleeve 2 toward the developing section.

After the image development with the abovementioned developing device, the powder image is transferred onto an image transfer paper, while irradiating a d.c. corona of +7 KV from the back surface of the paper, thereby obtaining the reproduction image. The developer still remaining on the photosensitive drum unused is removed by a cleaning blade of polyurethane. The image fixing is done by using a fuser roller (the surface of which is covered with silicone rubber) in a plain paper copying machine available in general market ("NP-5000", a product of Canon K.K.).

Figure 2:
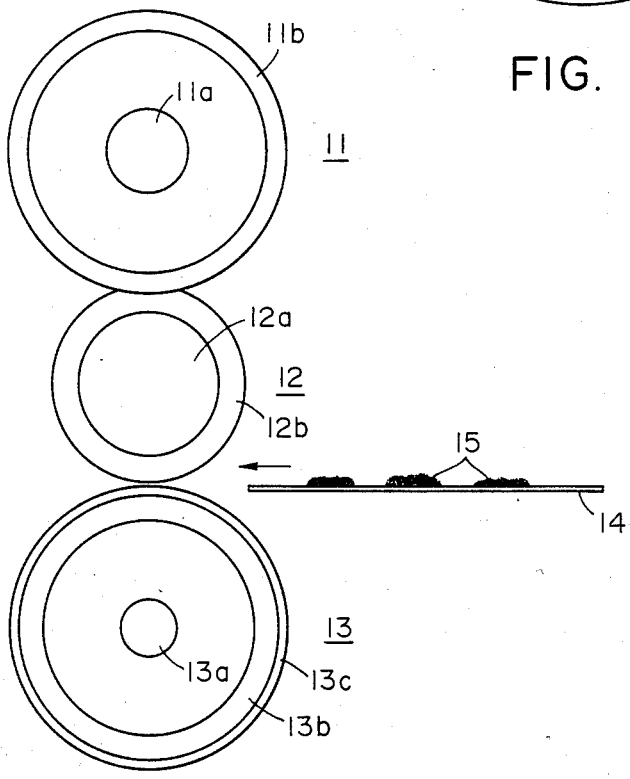
FIG. 2 is a schematic cross-sectional view of one example of a fuser roller image fixing device.

FIG. 2 is a schematic cross-sectional diagram of the abovementioned fuser roller. In the drawing, a numeral 11 refers to a roller having a heat source 11*a* in its interior, and a numeral 11*b* designates an aluminum drum. A reference numeral 12 designates a heat-fixing roller of a construction, wherein the peripheral surface of a core 12*a* is covered with silicon rubber 12*b* so as to receive heat from the abovementioned roller 11. A numeral 13 refers to a pressure roller which is in pair with the heat-fixing roller 12. The pressure roller 13 comprises an aluminum drum 13*b*, a silicone rubber covering 13 around the outer surface of the drum, and a heat source 13*a* disposed in its interior. This heat source 13*a* is weaker in its intensity that the abovementioned heat source 11*a*. The developing powder image on an image bearing member 14 is subjected to fusion and fixation while it is passing through the heat-fixing roller 12 and the pressure roller 13.

By the above-described electrophotographic process, there can be obtained a satisfactory reproduction image free from fogging. Even after the running test of 100,000 sheets of copy paper, the image density in the reproduced image is sufficiently high and favorable. Substantially no damage and toner fusion can be observed on the photosensitive drum, the cleaning blade, the developing sleeve, etc.

COMPARATIVE EXAMPLE 1

The same procedures as in Example 1 above are followed, except for use of 100 parts by weight of styrene-butyl acrylate copolymer having a mean molecular weight of 9000, but no styrene-butyl acrylate copolymer having a mean molecular weight of 205,000. While the initially reproduced image is good in quality, undesirable fogging increases as the running test proceeds, thereby pauperizing the image quality in the reproduced copies. The following Table shows comparative data of the image quality between Example 1 and Comparative Example 1.

| Number of sheet Reproduced | Ex. Example 1 Density Image Density | Ex. Example 1 Density Fogging Density | Ex. Comparative Example 1 Density Image Density | Ex. Comparative Example 1 Density Fogging Density |
|---|---|---|---|---|
| Initial sheet | 1.25 | 0.00 | 1.22 | 0.01 |
| 10,000 | 1.20 | 0.00 | 1.23 | 0.01 |
| 20,000 | 1.21 | 0.01 | 1.11 | 0.02 |
| 30,000 | 1.10 | 0.01 | 1.06 | 0.03 |
| 40,000 | 1.23 | 0.00 | 0.78 | 0.03 |
| 50,000 | 1.24 | 0.02 | 0.51 | 0.05 |
| 60,000 | 1.19 | 0.01 | machine stoppage | |
| 70,000 | 1.05 | 0.01 | | |
| 80,000 | 1.15 | 0.01 | | |
| 90,000 | 1.18 | 0.01 | | |
| 100,000 | 1.13 | 0.01 | | |

EXAMPLE 2

The same procedures as in Example 1 are followed, except for preparing toner from the following ingredients.

Polymer blend consisting of 92 parts by weight of styrene-butyl acrylate-butyl malenate copolymer having a mean molecular weight of 50,000 (monomer weight ratio of 70:20:10) and 8 parts by weight of styrene-butyl acrylate copolymer having a mean molecular weight of approx. 800,000 (monomer weight ratio of 65:35), and having peak values of 61,000 and approx.

1,000,000 in the molecular weight distribution curve by GPC . . . 100 parts by weight Magnetic powder (consisting of ferrite having an average particle diameter of 0.2 microns) . . . 50 parts by weight Metal containing dye . . . 2 parts by weight Polyethylene having a melt viscosity of approx. 30,000 cps at 140° C. . . . 3 parts by weight Carbon black . . . 5 parts by weight Favorable results can be obtained with the toner.

EXAMPLE 3

The same procedures as in Example 1 above are followed, except for preparing toner from the following ingredients.

Polymer blend consisting of 65 parts by weight of styrene-butyl methacrylate copolymer having a mean molecular weight of 21,000 (monomer weight ratio of 7:3) and 35 parts by weight of styrene-butyl methacrylate copolymer having a mean molecular weight of 260,000 (monomer weight ratio of 7:3), and having peak values of 22,000 and 275,00 in the molecular weight distribution curve by GPC . . . 100 parts by weight Magnetic powder (consisting of $Fe_3O_4$ having an average particle diameter of 0.3 microns) . . . 50 parts by weight Metal containing dye . . . 2 parts by weight Polyethylene having a melt viscosity of 4,300 cps at 140° C. . . . 3 parts by weight Favorable results can be obtained with the toner.

EXAMPLE 4

Substantially same procedures as in Example 1 above are followed, except for preparing toner from the following ingredients.

Polymer blend consisting of 40 parts by weight of styrene-butyl acrylate having a mean molecular weight of 14,000 (monomer weight ratio of 65:35) and 60 parts by weight of styrene-butyl acrylate-acrylonitrile copolymer having a mean molecular weight of 170,000 (monomer weight ratio of 65:30:5), and having peak values of 14,000 and 180,000 in the molecular weight distribution curve by GPC . . . 100 parts by weight Magnetic powder (consisting of $Fe_3O_4$ having an average particle diameter of 0.3 microns) . . . 40 parts by weight Metal containing dye . . . 2 parts by weight Polypropylene having a melt viscosity of 280 cps at 140° C. . . . 2 parts by weight Favorable results can be obtained with the toner.

EXAMPLE 5

Substantially same procedures as in Example 1 above are followed, except for preparing toner from the following ingredients.

Polymer blend consisting of 80 parts by weight of styrene-butyl acrylate copolymer having a mean molecular weight of 9,000 (monomer weight ratio of 65:35) and 20 parts by weight of styrene-butyl acrylate having a mean molecular weight of 205,000 (monomer weight ratio of 65:35), and having peak values of 10,500 and 220,000 in the molecular weight distribution curve by GPC . . . 100 parts by weight Magnetic powder (consisting of needle-shaped magnetite having an average particle diameter of 0.35 microns and an axis ratio of 8/1) . . . 70 parts by weight Metal containing dye . . . 2 parts by weight Polyethylene having a melt viscosity of approx. $3\times10^4$ at 140° C. . . . 4 parts by weight Favorable results can be obtained with the toner.

EXAMPLE 6

The following component materials are pulverized and well mixed in a ball mill, and then melted and kneaded in a roll mill.

Styrene-butyl acrylate copolymer having a peak value of 12,000 in the molecular weight distribution curve by GPC (monomer weight ratio of 8:2) . . . 70 parts by weight Styrene-butyl acrylate copolymer having a peak value of 210,000 in the molecular weight distribution curve by GPC (monomer weight ratio of 6:4) . . . 30 parts by weight Magnetic powder (consisting of $Fe_3O_4$ having an average particle diameter of 0.3 microns) . . . 60 parts by weight Metal containing dye ("Zapon Fast Black B", product of BASF) . . . 2 parts by weight After cooling the kneaded mixture, it is roughly crushed by a hammer mill, and then pulverized by a supersonic jet crusher. The thus obtained powder material is classified by an air classifier, out of which particles having particle size of from 5 to 35 microns are collected to be made the developing powder. 0.3 part by weight of hydrophobic colloidal silica powder is added to 100 parts by weight of this developing powder, and well mixed to be made the developing agent. The image development is carried out in the same manner as in Example 1 above using this developer. The image fixing is done by using a fixing device (a fuser roller with its outer surface covered with polyethylene fluoride resin) in a copying machine available in general market ("NP-200J", a product of Canon K.K.).

A clear image free from fogging is obtained. The image fixing property is also satisfactory. No twining of the reproduction paper around the image fixing roller and offsetting of the image thereto can be seen.

COMPARATIVE EXAMPLE 2

The same procedures as in Example 6 above are followed, except for preparing toner from the following ingredients.

Styrene-butyl acrylate copolymer having a molecular weight peak value of 12,000 in the molecular weight distribution curve by GPC (monomer weight ratio of 8:2) . . . 100 parts by weight Magnetic powder . . . 60 parts by weight Metal containing dye . . . 2 parts by weight It is found out that a part of the toner image obtained is offset onto the fixing roller, and the image quality is poor.

COMPARATIVE EXAMPLE 3

The same procedure as in Example 6 above are followed, except for preparing toner from the following ingredients.

Styrene-butyl acrylate copolymer having a molecular weight peak value of 210,000 in the molecular weight distribution curve by GPC (monomer weight ratio of 6:4) . . . 100 parts by weight Magnetic powder . . . 60 parts by weight Metal containing dye . . . 2 parts by weight It is found out that the image fixing is not satisfactory.

COMPARATIVE EXAMPLE 4

The same procedures as in Example 6 above are followed, except for preparing toner from the following ingredients.

Styrene-butyl acrylate copolymer having a molecular weight peak value of 100,000 in the molecular weight distribution curve by GPC (monomer weight ratio of 7:3) . . . 100 parts by weight Magnetic powder . . . 60 parts by weight Metal containing dye . . . 2 parts by weight It is found out that the image fixing is not satisfactory.

EXAMPLE 7

The same procedures as in Example 6 above are followed, except for preparing toner from the following ingredients.

Styrene-butyl acrylate copolymer having a molecular weight peak value of 45,000 in the molecular weight distribution curve by GPC (monomer weight ratio of 7:3) . . . 90 parts by weight Styrene-butyl acrylate copolymer having a molecular weight peak value of 800,000 in the molecular weight distribution curve by GPC (monomer weight ratio of 5:5) . . . 10 parts by weight Magnetic powder (consisting of ferrite having an average particle diameter of 0.2 microns) . . . 50 parts by weight Metal containing dye . . . 2 parts by weight A clear image free from fogging can be obtained. The image fixing property is also satisfactory.

EXAMPLE 8

The same procedures as in Example 6 above are followed, except for preparing toner from the following ingredients.

Styrene-butyl acrylate-butyl malenate copolymer having a molecular weight peak value of 26,000 in the molecular weight distribution curve by GPC (monomer weight ratio of 7.5:2:0.5) . . . 80 parts by weight Styrene-butyl acrylate-butyl malenate copolymer having a molecular weight peak value of 450,000 in the molecular weight distribution curve by GPC (monomer weight ratio of 6.5:3:0.5) . . . 20 parts by weight Metal containing dye . . . 2 parts by weight Magnetic powder (consisting of $Fe_3O_4$ having an average particle diameter of 0.3 microns) . . . 70 parts by weight Favorable results can be obtained with the developing powder.

EXAMPLE 9

The developing powder is prepared from the following ingredients.

Styrene-butyl methacrylate copolymer having a molecular weight peak value of 12,000 in the molecular weight distribution curve by GPC (monomer weight ratio of 8:2) . . . 50 parts by weight.

Styrene-butyl methacrylate copolymer having a molecular weight peak value of 183,000 in the molecular weight distribution curve by GPC (monomer weight ratio of 7:3) . . . 50 parts by weight Carbon black . . . 6 parts by weight Metal containing dye . . . 2 parts by weight Prussian blue . . . 2 parts by weight 12 parts by weight of this developing powder is mixed with 88 parts by weight of carrier iron powder ("EFV 250/400", product of Nippon Teppun K.K.). The image development is carried out by use of a copying machine available in general market ("NP-5000", product of Canon K.K.).

A clear image free from fogging can be obtained. The image fixing property is also satisfactory.

EXAMPLE 10

The same procedures as in Example 6 above are followed, except for preparing the developing powder from the following ingredients.

Styrene-butyl methacrylate copolymer having a molecular weight peak value of 16,000 in the molecular weight distribution curve by GPC (monomer weight ratio of 9:1) . . . 80 parts by weight Styrene-butyl methacrylate-lauryl methacrylate copolymer having a molecular weight peak value of 380,000 in the molecular weight distribution curve by GPC (monomer weight ratio of 7:2:1) . . . 20 parts by weight Magnetic powder . . . 50 parts by weight Metal containing dye . . . 2 parts by weight

EXAMPLE 11

The same procedures as in Example 6 above are followed, except for preparing toner from the following ingredients.

Styrene-butyl acrylate copolymer having a molecular weight peak value of 12,000 in the molecular weight distribution curve by GPC (monomer weight ratio of 8:2) . . . 75 parts by weight Styrene-butyl acrylate copolymer having a molecular weight peak value of 210,000 in the molecular weight distribution curve by GPC (monomer weight ratio of 6:4) . . . 25 parts by weight Polyethylene having a melt viscosity of 4,300 cps at 140° C. . . . 2 parts by weight Magnetic powder . . . 60 parts by weight Metal containing dye . . . 2 parts by weight A satisfactory image without fogging can be obtained. The image fixing property is also extremely good.

The following Table shows the image fixing temperature, anti-offset property, and fogging density in both Inventive Examples and Comparative Examples.

| | Fixing Temperature | Offset (200° C.) | Initial Fogging | Fogging After Copying 50,000 sheets |
|---|---|---|---|---|
| Comparative Example 2 | 150° C. | X | 0.01 | 0.04 (considerable fogging) |
| Comparative Example 3 | 200° C. | | 0.00 | — |
| Comparative Example 4 | 180° C. | Δ | 0.01 | — |
| Example 6 | 155° C. | | 0.01 | 0.01 |
| Example 7 | 160° C. | | 0.00 | 0.01 |
| Example 8 | 155° C. | | 0.00 | 0.01 |
| Example 9 | 135° C. | | 0.01 | 0.02 |

-continued

| | Fixing Temperature | Offset (200° C.) | Initial Fogging | Fogging After Copying 50,000 sheets |
|---|---|---|---|---|
| Example 10 | 155° C. | | 0.01 | 0.01 |
| Example 11 | 150° C. | | 0.00 | 0.01 |

X: Considerable offset
Δ: Notable offset
: Almost no offset
: Perfectly free from offset

What I claim is:

1. A fixing method which comprises fixing a developing powder by means of a fuser roller wherein said developing powder comprises one or more vinyl type copolymers exhibiting a peak value of molecular weight in each of the molecular weight regions of $5\times10^3$ to $8\times10^4$ and $10^5$ to $2\times10^6$, respectively, in a chromatogram as measured by gel permeation chromatography, wherein the content of said vinyl copolymers is 30 to 99% by weight with respect to the total weight of the developer powder and further containing an ethylene type olefin homopolymer or ethylene type olefin copolymer having a melt viscosity of 10 to $10^6$ cps at 140° C.

2. The fixing method as set forth in claim 1, wherein fine particles of magnetic material are contained in the developing powder in a range of from 15 to 70% by weight with respect to the total weight of the developing powder.

3. The fixing method as set forth in claim 1, wherein said vinyl type copolymer is a styrene type copolymer.

4. The fixing method as set forth in claim 1, wherein said developing powder is prepared by blending a vinyl type copolymer P having a molecular weight peak value in the molecular weight region of $5\times10^3$ to $8\times10^4$ and a vinyl type copolymer Q having a molecular weight peak value in the molecular weight region of $10^5$ to $2\times10^6$ at a blending ratio of Q/P=2/1 to 1/50, and wherein the principal component of the monomers of each of said copolymers P and Q is identical.

5. The fixing method as set forth in claim 3, wherein a copolymerization ratio of the styrene type monomer in the styrene type copolymer is 30 to 100% by weight.

6. The fixing method as set forth in claim 3, wherein the copolymerization component in the styrene type copolymer is an alkyl ester of acrylic acid.

7. The fixing method as set forth in claim 3, wherein the copolymerization component in the styrene type copolymer is an alkyl ester of methacrylic acid.

8. The fixing method as set forth in claim 3, wherein said developing powder contains a mixture of (1) a styrene type copolymer A having a mean molecular weight of $M_A$ and a copolymerization ratio of a styrene type monomer of $W_A$ % by weight and (2) a styrene type copolymer B having a mean molecular weight of $M_B$ and a copolymerization ratio of a styrene type monomer of $W_B$ % by weight in the relationship of $M_A<M_B$ and $W_A>W_B$.

9. The fixing method as set forth in claim 8, wherein the copolymerization ratio $W_A$ ranges from 50 to 98% by weight and the copolymerization ratio $W_B$ ranges from 35 to 90% by weight.

10. The fixing method as set forth in claim 1, wherein said developing powder contains only one of said vinyl type copolymers having a peak value in each of said molecular weight regions.

11. The fixing method as set forth in claim 1, wherein said developing powder contains a blend of two of said vinyl type copolymers, each having a peak value in one of said two molecular weight ranges.

12. A fixing method which comprises fixing a developing powder by means of a fuser roller wherein said developing powder comprises one or more vinyl type copolymers exhibiting a peak value of molecular weight in each of the molecular weight regions of $5\times10^3$ to $8\times10^4$ and $10^5$ to $2\times10^6$, respectively, in a chromatogram as measured by gel permeation chromatography, wherein the content of said vinyl copolymers is 30 to 99% by weight with respect to the total weight of developer powder and further containing an ethylene type olefin homo- or co-polymer having a melt viscosity of 10 to $10^6$ cps at 140° C., wherein said developing powder contains 0.1 to 5% by total weight of developing powder of said ethylene type olefin polymer.

13. A fixing method which comprises fixing a developing powder by means of a fuser roller wherein said developing powder comprises:

(a) from 30 to 99% by total weight of developing powder of a blend of a vinyl type copolymer P having a molecular weight peak value in the range from $5\times10^3$ to $8\times10^4$ and a vinyl type copolymer Q having a molecular weight peak value in the range from $10^5$ to $2\times10^6$, wherein the weight ratio of Q/P is 2/1 to 1/50 and wherein the principal component of the monomers of each of P and Q is identical and, (b) from 0.1 to 5% by total weight of developing powder of an ethylene type olefin homo- or copolymer having a melt viscosity of 10 to $10^6$ cps at 140° C.

14. A developing powder for fuser roller fixing comprising one or more vinyl type copolymers exhibiting a peak value of molecular weight in each of the molecular weight regions of $5\times10^3$ to $8\times10^4$ and $10^5$ to $2\times10^6$ respectively, in a chromatogram as measured by gel permeation chromatography and an ethylene type olefin homo- or copolymer having a melt viscosity of 10 to $10^6$ cps at 140° C.

15. A developing powder for fuser roller fixing comprising one or more vinyl type copolymers exhibiting a peak value of molecular weight in each of the molecular weight regions of $5\times10^3$ to $8\times10^4$ and $10^5$ to $2\times10^6$ respectively, in a chromatogram as measured by gel permeation chromatography and in ethylene type olefin homo- or copolymer having a melt viscosity of 10 to $10^6$ cps at 140° C., wherein the content of said vinyl copolymers is 30 to 99% by weight and the content of said ethylene type olefin polymer is from 0.1 to 5% by weight, said weights based on the total weight of the developer powder.

16. A developing powder for fuser roller fixing comprising:

(a) from 30 to 99% by total weight of developing powder of a blend of a vinyl type copolymer P having a molecular weight peak value in the range from $5\times10^3$ to $8\times10^4$ and a vinyl type copolymer Q having a molecular weight peak value in the range from $10^5$ to $2\times10^6$, wherein the weight ratio of Q/P is 2/1 to 1/50 and wherein the principal component of the monomers of each of P and Q is identical and, (b) from 0.1 to 5% by total weight of developing powder of an ethylene type olefin homo- or copolymer having a melt viscosity of 10 to $10^6$ cps at 140° C.

17. The fixing method as set forth in claim 1, wherein the vinyl type copolymers having the respective molecular weights in the molecular weight regions of $5\times10^3$ to $8\times10^4$ and $10^5$ to $2\times10^6$ in a chromatogram as measured by gel permeation chromatography are styrene type copolymers containing as a main component a styrene type monomer.

18. The fixing method as set forth in claim 4, wherein the vinyl type copolymers P and Q are both styrene type copolymers containing as a main component a styrene type monomer.

19. The developing powder as set forth in claim 14, wherein the vinyl type copolymers having the respective molecular weights in the molecular weight regions of $5\times10^3$ to $8\times10^4$ and $10^5$ to $2\times10^6$ in a chromatogram as measured by gel permeation chromatography are styrene type copolymers containing as a main component a styrene type monomer.

20. A developing powder for fuser roller fixing comprising:

(a) from 30 to 99% by total weight of developing powder of a blend of a vinyl type copolymer P having a molecular weight peak value in the range from $5\times10^3$ to $8\times10^4$ and a vinyl type copolymer Q having a molecular weight peak value in the range from $10^5$ to $2\times10^6$, wherein the weight ratio of Q/P is 2/1 to 1/50 and wherein the principal component of the monomers of each of P and Q is identical and, (b) an ethylene type olefin homo- or copolymer having a melt viscosity of 10 to $10^6$ cps at 140° C.

21. The developing powder as set forth in claim 20, wherein the vinyl type copolymers P and Q are both styrene type copolymers containing as a main component a styrene type monomer.

22. A process for forming an image comprising the steps of:

developing a latent image with a developing powder comprising one or more vinyl type copolymers exhibiting a peak value of molecular weight in each of the molecular weight regions of $5\times10^3$ to $8\times10^4$ and $10^5$ to $2\times10^6$, respectively, in a chromatogram as measured by gel permeation chromatography and an ethylene type olefin homo- or copolymer having a melt viscosity of 10 to $10^6$ cps at 140° C., and transferring the image thus developed to an image receiving member.

23. The process for forming an image as set forth in claim 22, further comprising the step of removing the developing powder remaining on the latent image holding member after the developing step by the blade cleaning system.

* * * * *

UNITED STATES PATENT AND TRADEMARK OFFICE

CERTIFICATE OF CORRECTION

PATENT NO. : 4,499,168

DATED : February 12, 1985

INVENTOR(S) : YASUO MITSUHASHI

It is certified that error appears in the above-identified patent and that said Letters Patent is hereby corrected as shown below:

Column 14, table: under "offset" column, insert --0-- across from "Comparative Example 3"; "Example 6"; "Example 7"; "Example 8"; and "Example 9".

Column 15, table: under "offset", insert --0-- across from "Example 10" and insert --0-- across from "Example 11".

Signed and Sealed this

Twenty-first Day of October, 1986

[SEAL]

*Attest:*

DONALD J. QUIGG

*Attesting Officer* *Commissioner of Patents and Trademarks*